United States Patent [19]

Lubojatsky et al.

[11] 3,996,753

[45] Dec. 14, 1976

[54] MINE ROOF SUPPORT

[75] Inventors: Walter Lubojatsky, Recklinghausen; Wilhelm Wertelewski, Datteln, both of Germany

[73] Assignee: Becorit Grubenausbau GmbH, Recklinghausen, Germany

[22] Filed: July 15, 1975

[21] Appl. No.: 596,161

Related U.S. Application Data

[63] Continuation-in-part of Ser. No. 441,485, Feb. 11, 1974, Pat. No. 3,908,389.

[30] Foreign Application Priority Data

Feb. 27, 1973 Germany ..... 2309670

[52] U.S. Cl. ..... 61/45 D

[51] Int. Cl.[2] ..... E21D 15/44

[58] Field of Search ..... 61/45 D; 299/31, 33; 248/357; 91/170 MP

[56] References Cited

UNITED STATES PATENTS

| | | | |
|---|---|---|---|
| 3,302,411 | 2/1967 | Wilkenloh et al. | 61/45 D |
| 3,324,664 | 6/1967 | Allen | 61/45 D |
| 3,483,705 | 12/1969 | Roberts | 61/45 D |
| 3,530,490 | 9/1970 | Ward et al. | 61/45 D X |

*Primary Examiner*—Dennis L. Taylor

*Attorney, Agent, or Firm*—Berman, Aisenberg & Platt

[57] ABSTRACT

The invention is concerned with a mine roof support, for use at a mineral face, comprising a base member, extensible props means mounted on said base member, a roof-engaging structure mounted on said prop means for application thereby to a roof to be supported, a multi-part flushing screen shield including upper and lower parts arranged on the goaf side of the support, first hinge means mutually connecting the parts of said screening shield ad having a flexible member connecting the upper part of the shield and the roof-engaging structure and which permits movements of the upper part of the shield about an axis lying transversely to the longitudinal direction of the mineral face, and second hinge means connecting the lower part of the shield with the base member and having a hinge axis which lies transversely to the longitudinal direction of the mineral face, whereby the screening shield is pivotally movable with respect to the support not only towards and away from the mineral face but also parallel thereto. The present invention provides such a mine roof support with prop aligning means, including a cylinder incorporating aligning force producing means, arranged between props of the support on the one hand and the base member or parts connected with the base member on the other hand and which aligning means also serve for swivelling of the flushing screen about the hinge means between the base member and the lower part of the flushing shield. The aligning devices may have pressure-medium cylinders which serve for application of the aligning forces or said aligning devices may have resilient restoring elements.

8 Claims, 4 Drawing Figures

Figure 3:
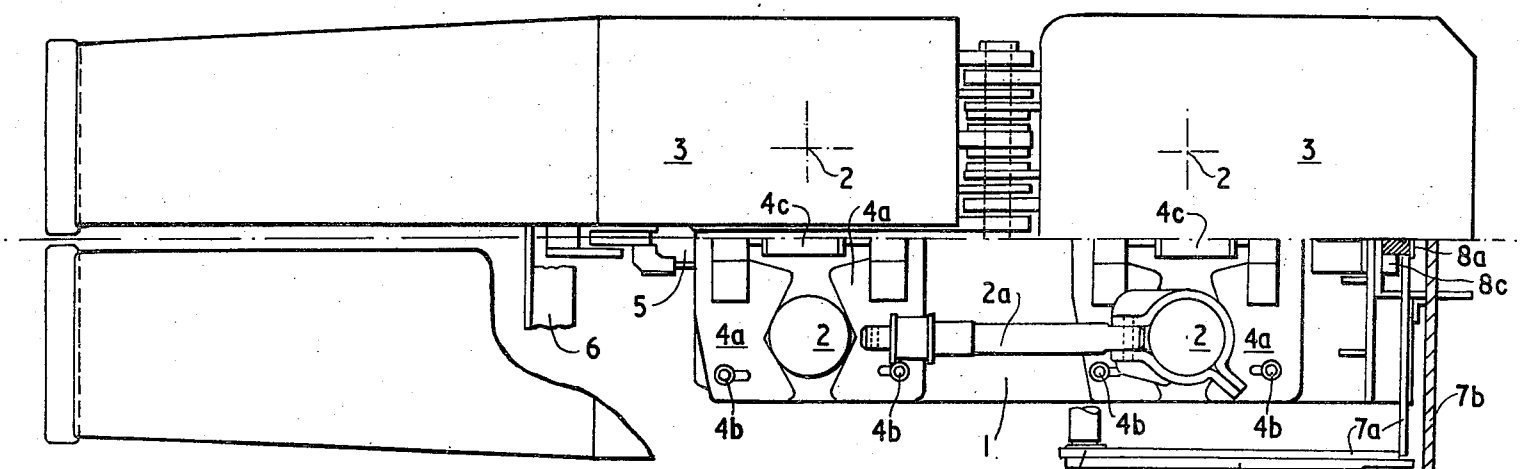

—FIG. 4.—
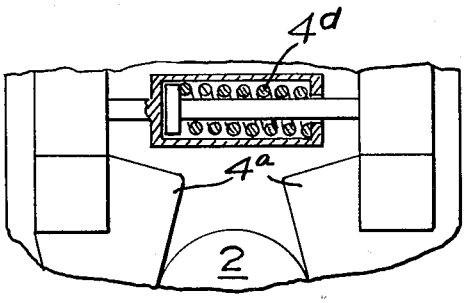
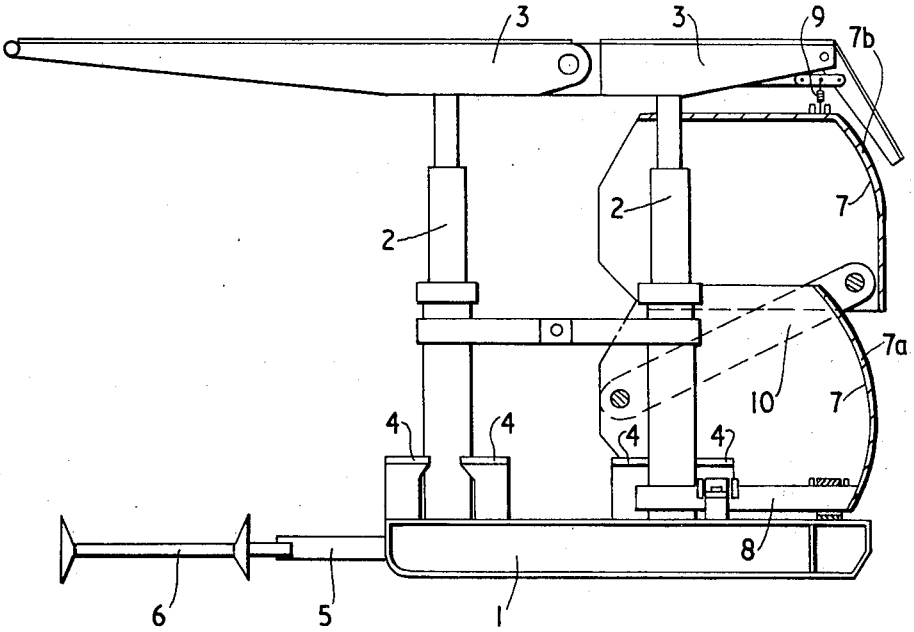
—FIG. 1—

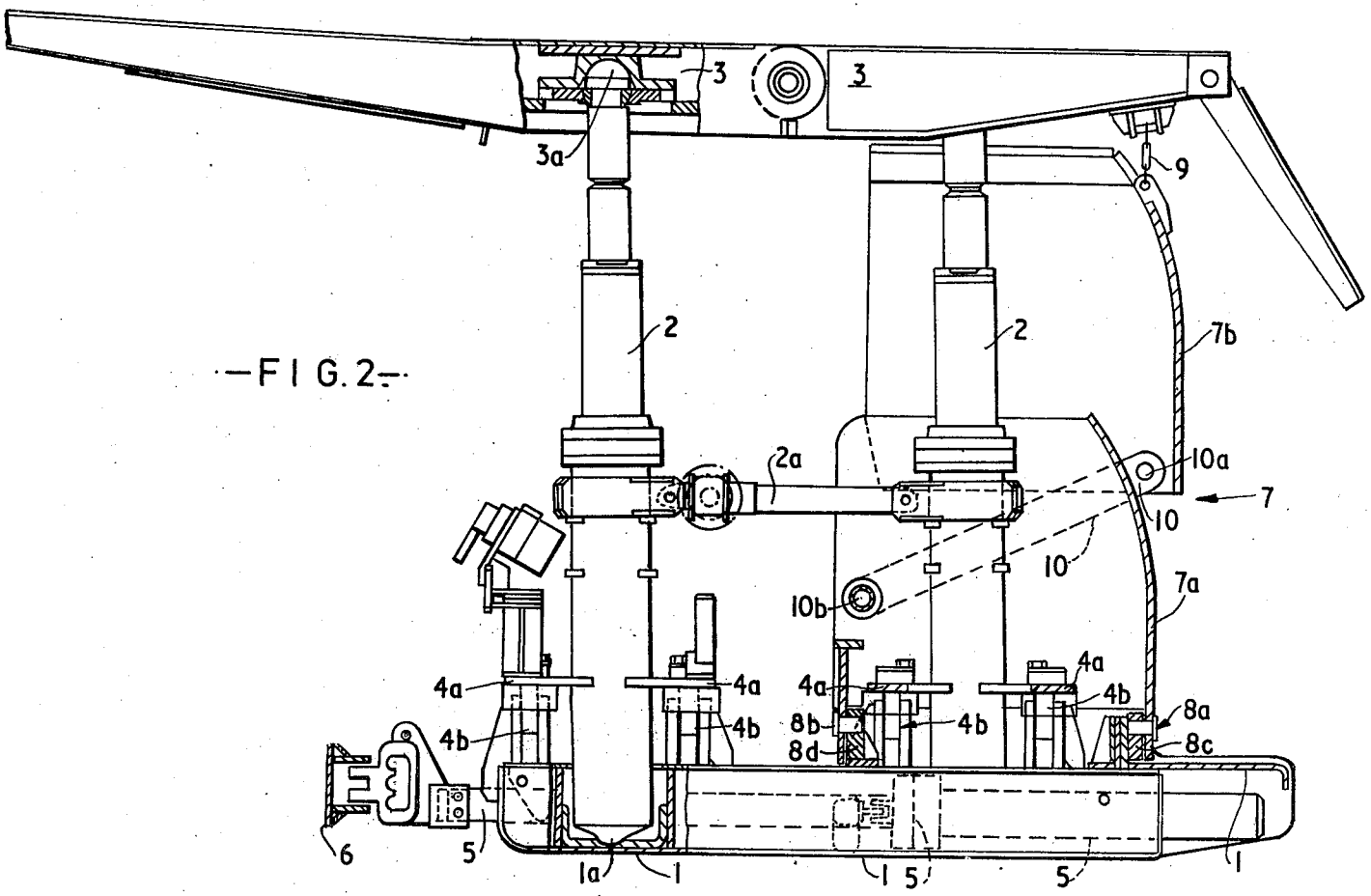
—FIG. 2—

MINE ROOF SUPPORT

This application is a continuation-in-part application of U.S. application Ser. No. 441,485 filed Feb. 11, 1974, now U.S. Pat. No. 3,908,389, and which is concerned with a mine roof support.

In the specification of the above-mentioned application Ser. No. 441,485 there is described and claimed a mine roof support, for use at a mineral face, comprising a base member, extensible prop means mounted on said base member, a roof-engaging structure mounted on said prop means for application thereby to a roof to be supported, a multi-part flushing screen shield including upper and lower parts arranged on the goaf side of the support, first hinge means mutually connecting the parts of said screening shield and having a flexible member connecting the upper part of the shield and the roof-engaging structure and which permits movements of the upper part of the shield about an axis lying transversely to the longitudinal direction of the mineral face, and second hinge means connecting the lower part of the shield with the base member and having a hinge axis which lies transversely to the longitudinal direction of the mineral face, whereby the screening shield is pivotally movable with respect to the support not only towards and away from the mineral face but also parallel thereto.

With the above described arrangement the parts of the flushing screen shield and especially the hinge means are protected from overloading and deformations which can occur when the base plate is inclined laterally because of irregularities of the floor or when movements parallel to the stratification between roof and floor occur in the longitudinal direction of the face.

In order, after inclination of the flushing screen shield together with the support, to be able to align it again into the normal position relative to the underpart of the support, the present invention provides the above described mine roof support with prop aligning means, including a cylinder incorporating aligning force producing means, arranged between props of the support on the one hand and the base member or parts connected with the base member on the other hand and which aligning means also serve for swivelling of the flushing screen shield about the hinge means between the base member and the lower part of the flushing screen shield.

Conveniently the prop aligning cylinder is a pressure-medium ram which serves for application of the aligning forces. Alternatively the prop aligning cylinder incorporates a resilient restoring means which is stressed and then recoils to apply an aligning force to the props.

Embodiments of the invention will now be described, by way of example, with reference to the accompanying drawings in which:

FIG. 1 shows a mine roof support schematically in side elevation and partly in section, FIG. 2 is also a side elevation of said support, partly in section, but shows the construction in greater detail, FIG. 3 is a plan view of the support as shown in FIG. 2, and FIG. 4 is an enlarged plan view of a modified alignment device.

The support shown on the drawings comprises a base plate 1 on which are arranged several props 2 which mutually support a roof bar construction 3. Displacement of the props 2 on the base plate 1 and relatively to the roof bar construction 3 takes place flexibly all round due to pivotal arrangements provided at 1*a* and 3*a* respectively.

Alignment means 4 are arranged on the base plate 1 and serve for the alignment of the props 2 relative to the base plate 1. Each of the aligning means 4 has two aligning elements 4*a* arranged in a horizontal plane and which embraces the associated prop 2 from front and rear. The elements 4*a* are hingedly connected to the base, for hinging movement in a horizontal plane, by hinging devices 4*b*. On the opposite side of the props, the hinging devices 4*b*, the aligning elements 4*a* are connected with one another through a hydraulic cylinder or ram 4*c*. The aligning elements 4*a* have, on the edges facing each other and lying on the prop 2, V-shaped indentations through which the position of the associated prop 2 is fixed.

On pivotal movement of a prop 2 about its support point 1*a* on the base plate, the aligning elements 4*a* pivot about their hinging devices 4*b* and the hydraulic cylinder 4*c* is extended under the influence of the deflecting forces. For realignment of the prop 2, from the deflected position to the normal position the hydraulic cylinder 4*c* is charged with pressure-fluid whereby the prop is again pivoted into the centre position between the two indentations in the aligning elements 4*a*.

If desired the hydraulic cylinder 4*c* can be replaced by a correspondingly arranged cylinder incorporating a prestressed spring means 4*d*, as shown in FIG. 4, which on pivoting of the prop 2 from the normal position can be further stressed and the recoil forces can swing back the deflected prop 2 to the normal position, as soon as the support assembly is released from between the roof and floor. Also if desired other suitably constructed and arranged aligning devices can be provided between the base plate 1 and the props 2.

For fixing and adjusting the relative positions of the props 2, arranged behind one another in the direction of advance, these are connected with one another through longitudinally adjustable spacing members 2*a*. Furthermore the base plate 1 is provided with a support advancing ram 5 the reciprocatable piston rod of which acts on a mineral face conveyor 6.

On the goaf side of the support assembly there is provided a flushing screen indicated generally by reference numeral 7. The flushing screen 7 consists of two box-like elements 7*a* and 7*b* which are open towards the coal face and embrace with their side walls the flanks of the rearward props 2 of the support. The lower box element 7*a* is connected through hinge pins 8*a* and 8*b* with the base plate 1. The hinge pins 8*a* and 8*b* are fastened on the goaf side and the face side to the lower box element 7*a* and lie on a common axis which runs parallel to the floor and transversely to the longitudinal direction of the face and, as viewed from the mineral face, approximately centrally of the support. The hinge pins 8*a* and 8*b* are hingedly supported about their common axis in bearing elements 8*c* and 8*d* arranged on the base plate 1.

The upper box element 7*b* is hingedly connected, so as to be universally movable, to the roof bar construction 3 by means of a chain 9 or other universal hinge or joint. Furthermore the box elements 7*a* and 7*b* are mutually connected by guide bars 10, which hingedly engage on the side walls of the lower box element 7*a* and in the region of the rear wall of the upper box element 7*b*. The hinge axes, which extend through the hinges 10*a* and 10*b* of the guide bar 10, lie in the longitudinal direction of the face.

As can be seen from the drawing the flushing screen boxes 7*a* and 7*b* form a unit which is pivotable in a plane, perpendicular to the roof and in the longitudinal direction of the face. Because of this the flushing screen 7 with its hinges 10*a* and 10*b* lying in the longitudinal direction of the face no longer prevents inclination of the base plate 1 in the longitudinal direction of the face. Also in displacements parallel to the stratification between roof and floor in the longitudinal direction of the face the flushing screen can tilt correspondingly without its hinges being overloaded or that impact of the props on the side walls of the box elements 7*a* or 7*b* needs to be feared. It will be understood that if the props do impact on the side walls of the box elements 7*a* and 7*b* of the flushing screen shield any objectionable displacement of the latter will be corrected by swivelling of the flushing screen shield, about the hinge means between the base member and the lower part of the flushing screen shield, by the props when the aligning means act to align the latter.

In place of the hinge pins 8*a* and 8*b* used in this embodiment, clearly other connecting means between the lower box element 7*a* and base plate 1 can be arranged, which permit movement of the flushing screen box 7 relative to the base plate 1 in the plane lying in the longitudinal direction of the face and perpendicular to the floor. For this purpose pin connections with longitudinal holes can be used, for example, which are arranged on both sides on the base plate. Likewise there can also be used quadrilateral links or the like as connecting means, the hinge axes of which lie parallel to the floor and transversely to the longitudinal direction of the face. Similar connecting means can also be arranged between the upper box element 7*b* and the roof bar construction 3.

We claim:

1. A mine roof support, for use at a mineral face, comprising a base member, extensible props means mounted on said base member, a roof-engaging structure mounted on said prop means for application thereby to a roof to be supported, a multi-part flushing screen shield including upper and lower parts arranged on the goaf side of the support, first hinge means mutually connecting the parts of said screening shield and having a flexible member connecting the upper part of the shield and the roof-engaging structure and which permits movements of the upper part of the shield about an axis lying transversely to the longitudinal direction of the mineral face, and second hinge means connecting the lower part of the shield with the base member and having a hinge axis which lies transversely to the longitudinal direction of the mineral face, whereby the screening shield is pivotally movable with respect to the support not only towards and away from the mineral face but also parallel thereto, and prop aligning means, including a cylinder incorporating aligning force producing means, arranged between props of the support on the one hand and the base member or parts connected with the base member on the other hand and which aligning means also serve for swivelling of the flushing screen shield about the hinge means between the base member and the lower part of the flushing screen shield.

2. A roof support as claimed in claim 1 wherein the prop aligning cylinder is a pressure-medium ram which serves for application of the aligning forces.

3. A roof support as claimed in claim 1 wherein the prop aligning cylinder incorporates a resilient restoring means which is stressed and then recoils to apply an aligning force to the props.

4. A roof support as claimed in claim 1 wherein said flexible member connecting the upper part of the shield and the roof-engaging structure is a universal hinge or joint.

5. A roof support as claimed in claim 1 wherein the hinge axis of the second hinge means when viewed from the mineral face is disposed approximately centrally of the support.

6. A roof support as claimed in claim 5 wherein the hinge axis of said second hinge is parallel to the floor of the mine.

7. A roof support as claimed in claim 1 wherein the prop aligning means comprises two hinged aligning elements which embrace the prop means from front and rear and are connected together by the prop aligning cylinder.

8. A roof support as claimed in claim 7 wherein the aligning elements have U-shaped indentations in which the prop means is embraced.

* * * * *